United States Patent [19]

Cros

[11] 4,449,389

[45] May 22, 1984

[54] DEVICE FOR BENDING A TOOL HOLDER OF A FOLDING PRESS OR THE LIKE

[75] Inventor: Pierre Cros, Saint-Cloud, France

[73] Assignee: Promecam Sisson-Lehmann, Saint-Denis, France

[21] Appl. No.: 384,662

[22] Filed: Jun. 3, 1982

[30] Foreign Application Priority Data

Jun. 16, 1981 [FR] France ..... 81 11805

[51] Int. Cl.[3] ..... B21D 9/05

[52] U.S. Cl. ..... 72/389; 72/446; 409/238; 100/46

[58] Field of Search ..... 72/446, 389, 386, 465, 72/447, 413, 448; 408/235; 409/238, 239; 100/258 R, 258 A, 46

[56] References Cited

FOREIGN PATENT DOCUMENTS 2007259 11/1971 Fed. Rep. of Germany .

*Primary Examiner*—Leon Gilden
*Assistant Examiner*—Linda McLaughlin
*Attorney, Agent, or Firm*—Young & Thompson

[57] ABSTRACT

This device for bending the tool holder of a folding press comprises structure for controlling the deformation of the wedge secured at either end, in the form of a hollow screw engaged in a socket rigid with the tool holder so that it can accomplish movements of translation within this socket, a member for fastening the screw to the wedge, a sprocket mounted coaxially to the screw on the screw-threaded shank thereof for causing the translation of the screw in the socket, and a single driving system for controlling the rotation of the set of sprockets acting at different thrust points disposed at spaced intervals along the wedge, this single wedge having a relatively great length and being therefore easily deformable under the control of the single control system.

8 Claims, 7 Drawing Figures

DEVICE FOR BENDING A TOOL HOLDER OF A FOLDING PRESS OR THE LIKE

BACKGROUND OF THE INVENTION

1. Field of the Invention

This invention relates in general to folding presses or like machines and has specific reference to a device for bending the tool holder of a machine of this type.

Hydraulic folding presses comprise a fixed beam and a movable beam, the fixed beam being supported at either end. The movable beam is actuated by hydraulic cylinders also disposed in most instances on either side.

These cylinders provide the power necessary for folding the sheet metal which, by reaction, causes the deformation of the two beams in the opposite direction. The distance between the two beams is therefore variable throughout the working period and consequently the folding angle becomes irregular in that it is greater in the central portion than at the ends of the beam assembly. Therefore, the sheet metal bending is more pronounced at its ends than in its central portion.

Various means have already been proposed with a view to impart a certain camber to the tool portions bearing against one of the beams. This bending should be adapted to each type of folding operation to be performed. It is subordinate on the one hand to the power requirements per unit length of sheet metal to be folded, and on the other hand to the length of the workpiece.

Therefore, the operator should be in a position to adjust this tool bending as a function of these two requirements.

2. The Prior Art

Several arrangements have been proposed for solving this problem. Inter alia, the French Pat. Nos. 1,132,633, 1,362,471 and 1,539,817 provide an arrangement in which hydraulic cylinders are mounted in the central portion of the press, whereby the beam distortion curves have the same direction and magnitude, thus ensuring a regular and accurate folding of the sheet metal.

Another French Pat. No. 2,347,992 discloses a folding press in which one of the beams comprises two sections, namely a first section supported or actuated at one end and another section, or bolster, supporting the corresponding tool; these two sections are connected by means of one or two common pins disposed symmetrically in relation to the transverse median plane and relatively close to this plane.

The two-section beam may comprise prestress means at either end for causing initially the operative section of this beam, i.e. the working tool supporting section, to undergo a distortion of same direction and substantially parallel to the deformation produced in the other beam when subjected to the folding stress.

With this arrangement, the deformation curves obtained for the two operative edges of the fixed and movable beams are as close as possible to each other.

Another French Pat. No. 1,420,380 describes a set of shims or liners disposed between one of the beams and the corresponding folding tool member; the thickness of these shims varies in the longitudinal direction of the tool and is adjustable separately in order to provide the desired bending curve. A further French Pat. No. 2,078,874 discloses the use of a single shim in the form of a tapered elongated bar movable laterally by means of separately adjustable set screws.

Another solution is contemplated in the German Pat. No. 1,752,346 disclosing a bending device comprising a set of wedges or shims fastened to a support extending along the beam and reacting against tapered surfaces, all these wedges having a tapered face in the longitudinal direction of the tool and being adjustable by means of a common mechanical device disposed at one end of the row of wedges. Other known constructions comprise hydraulic means for bending the tool; thus, the French Pat. No. 2,200,064 discloses a press in which one of the tools is supported by several vertical hydraulic cylinders disposed at spaced intervals along the press and interconnected by a closed-loop hydraulic system.

On the whole, these known bending devices are relatively complicated and therefore expensive.

SUMMARY OF THE INVENTION

It is the primary object of the present invention to provide a particularly simple yet efficient bending device for the purpose set forth hereinabove, which can be controlled by means of a single manual or powered control system.

According to the instant invention, the means for controlling the wedge deformation comprise at each specific transverse thrust location a hollow screw engaging a tapped hole formed in a socket rigid with the tool holder or bolster, so that said screw can be moved for axial translation within said socket, a member for fastening the screw to said wedge, a sprocket mounted coaxially to said screw on a screw-threaded portion of said screw to permit the movement of translation of the screw in the socket and a single drive member for controlling the rotation of the set of sprockets and consequently the deformation of the wedge assembly through the thrust exerted by the hollow screws against the wedge.

This single, relatively long wedge is easily bent and particularly simple to manufacture. As a result, controlling the wedge deformation or curvature requires but a relatively moderate effort in comparison with the efforts necessary for controlling the wedge distortion in prior art devices of this character.

The means for controlling the pinion rotation comprises a roller chain engaging all the sprockets and adapted to be driven either manually by means of an end handwheel or by a motor responsive to a switch or to programmable means if the folding press is controlled by a digital control unit or computer.

In a preferred form of embodiment of the present invention the support member consists of a second fixed wedge extending throughout the length of the tool holder or bolster and interposed between the first movable wedge and the body of the corresponding beam, and the wedges are provided with holes engaged by members such as screws for fastening the tool holder to the beam body, the hole in the movable wedge being so dimensioned as to provide a certain transverse play on either side of the fastening members, thus permitting a certain transverse play between the wedge and its supporting member.

Under these conditions, the two wedges engage each other with their tapered faces extending in the longitudinal direction of the machine, whereby the transverse deformation of the movable wedge on the fixed wedge will bring about an adequate and corresponding bending curvature of the tool holder or bolster.

Other features and advantages of the invention will appear as the following description proceeds with reference to the accompanying drawings illustrating diagrammatically by way of example two forms of embodiment of the invention.

THE DRAWINGS

Figure 6:
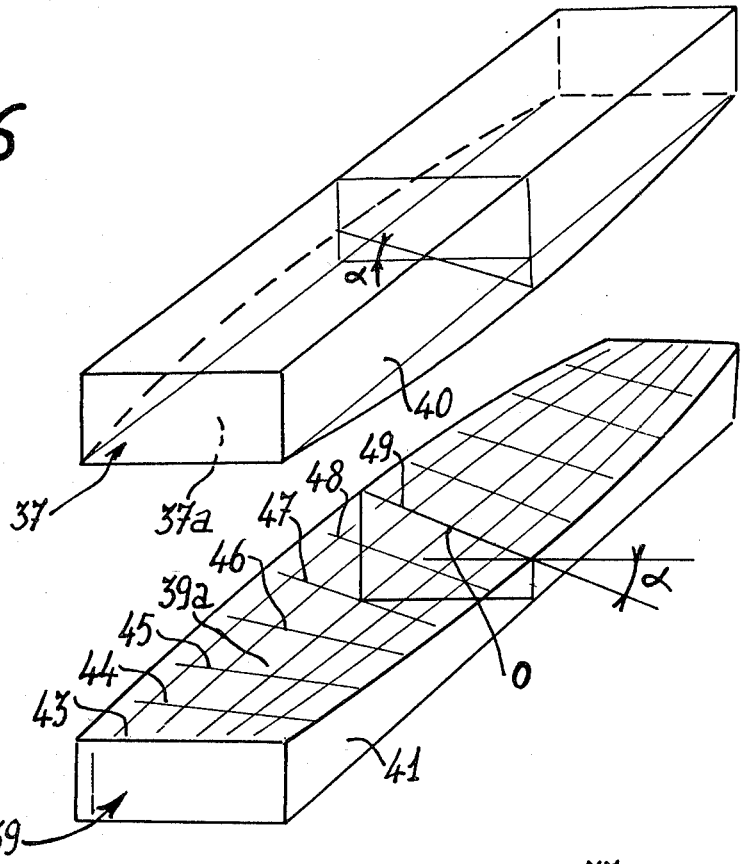
Figure 7:
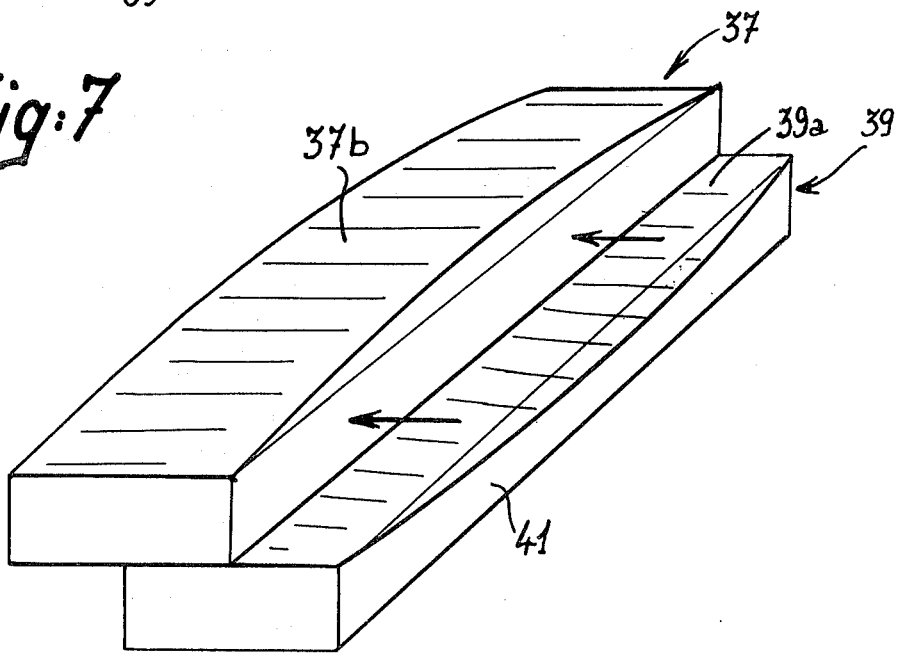

FIG. 6 is a perspective view showing a second form of embodiment of the deformable wedge with its fixed support member, this form of embodiment comprising two identical elements shown in their upside-down positions; and FIG. 7 is a perspective view of the two wedges of FIG. 6, the upper wedge being disposed upon, and shifted laterally in relation to, the fixed lower wedge, so that the upper wedge is bent.

DESCRIPTION OF THE PREFERRED EMBODIMENTS

Figure 1:
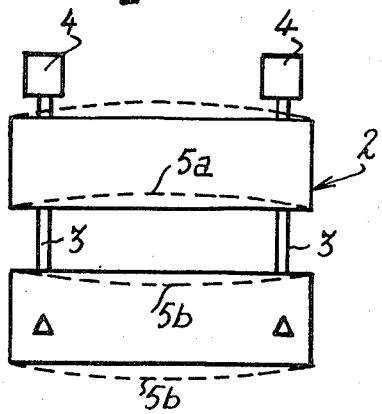
FIGS. 1 and 2 are diagrammatic side elevational views of a folding press or like machine, showing the distortion of the top and bottom beams during a folding operation and the initial or preliminary bending of one of the tool holding beams, respectively.
Figure 2:
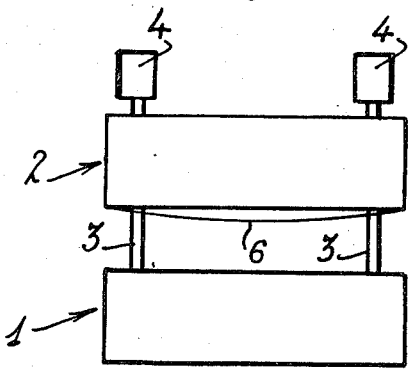

Referring first to FIGS. 1 and 2 of the drawings which show diagrammatically a folding press comprising essentially a fixed bottom beam 1 and a movable top beam 2. Each beam carries a folding tool and the movable top beam 2 is slidably mounted on columns 3 equipped with hydraulic actuators or cylinders 4.

The power output of cylinders 4 is sufficient for folding the sheet metal workpiece (not shown), this folding action being attended by a distortion in the opposite direction of the bottom and top beams 1 and 2 (see chain-line curves 5*a* and 5*b*). As a result, the distance between said beams 1 and 2 is not kept at a constant value throughout their length, and therefore unevennesses develop during the sheet metal folding step.

To avoid this inconvenience, it is one object of this invention to impress an initial or preliminary bending force on one the press tools, for example as shown by the curve 6 corresponding to the distortion of the tool carried by the top beam 2 (FIG. 2).

The bending device according to the present invention comprises a single wedge 7 (FIG. 5) extending throughout the length of one of the beam tool holders, in this example the lower beam 1 supporting a folding die or bottom tool (not shown). The wedge 7 is disposed between a bolster 8 (constituting the tool holder of the folding die or bottom tool) and a member 9 supporting the tool holder or bolster 8 supported in turn by the horizontal top surface 11 of the bottom beam 1.

The top face of wedge 7 is horizontal and the bottom face 7*a* of this wedge 7 is inclined by an angle $\alpha$ and bears on an inclined face 9*a* having the same slope as the fixed supporting wedge 9. The inclined faces 7*a* and 9*a* extend transversely to the plane of the body of beam 1 and therefore to the longitudinal dimension of the folding die or bottom tool.

Of course, the bottom wedge 9 and the top wedge 7 have the same length, and both wedges 7 and 9 together with the upper portion of the body of beam 1 are adapted to fit in a corresponding recess formed in tool holder or bolster 8.

Figure 3:
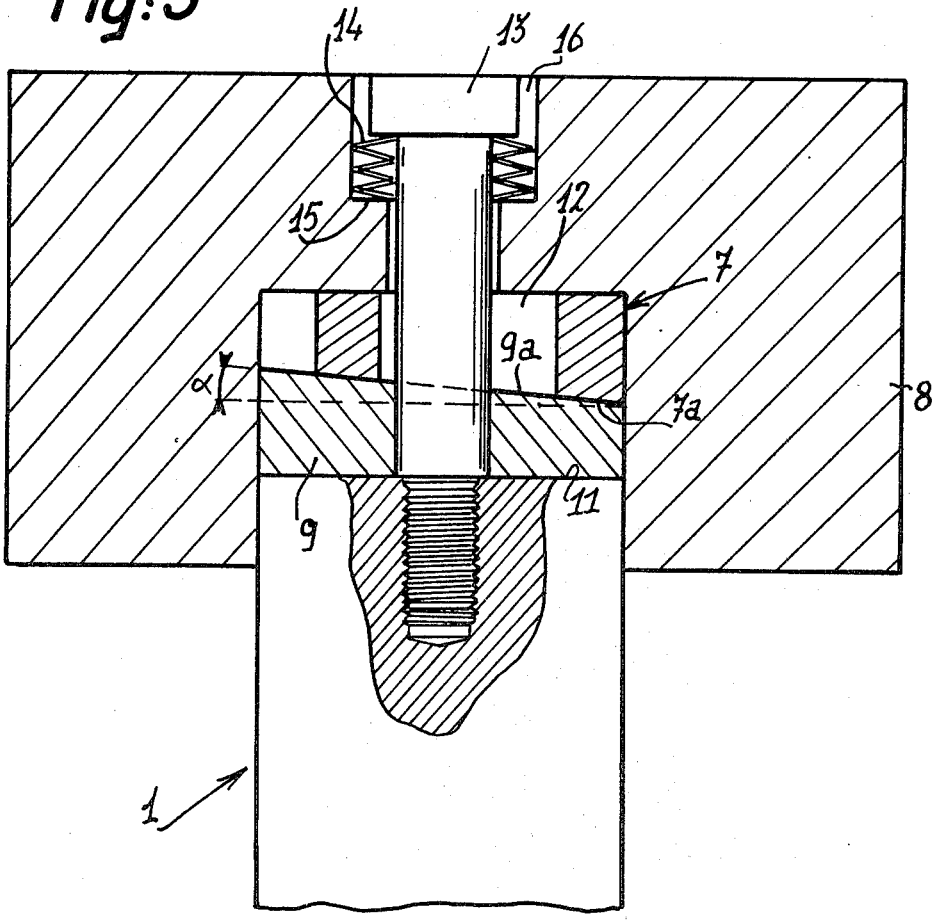
FIG. 3 is a fragmentary cross section showing on a larger scale the lower beam of a folding press according to a first form of embodiment of the invention.

Elongated holes 12 extending across the longitudinal dimension of wedge 7 are formed at spaced intervals in this wedge 7 and engaged by means for fastening the tool holder 8 to the body of beam 1, said fastening means consisting of screws 13 (FIG. 3). Since the major cross-sectional dimension of each elongated hole 12 extends across the wedge 7, a clearance is provided on either side of each screw 13 to permit a transverse free sliding movement of the wedge 7 on its supporting member 9.

Thus, each screw 13 extends through the bolster 8, the corresponding hole 12 and the hole formed through the fixed wedge 9 before engaging the tapped hole formed in the body of beam 1. Spring washers 14 react between the heads of said screws 13 and the annular bottom surface 15 of a recess 16 formed in bolster 8.

The ends of wedge 7 are retained at two fixed locations 17 between which the wedge 7 can undergo a certain elastic deformation.

Figure 4:
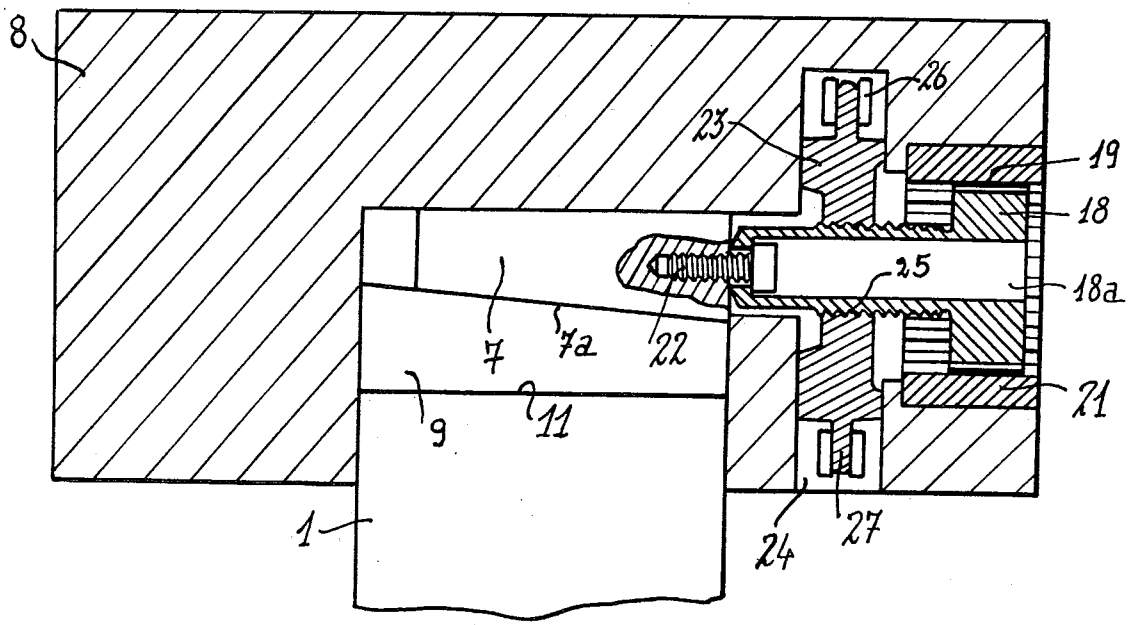
FIG. 4 is a fragmentary cross sectional view similar to FIG. 3 taken across one of the devices disposed at spaced intervals along the wedge for exerting transverse thrusts on this wedge.

In the modified form of embodiment illustrated in FIG. 4 the means for exerting transverse thrusts on wedge 7 comprise at each thrust application point a hollow screw 18 formed with splines 19 parallel to the screw axis and engaging corresponding splines formed in a socket 21 rigid with the bottom bolster 8, so that the screw 18 can move axially through the socket 21 without rotating in relation thereto. This hollow screw 18 is coupled to wedge 7 by means of a screw 22 adapted to be introduced into the axial cavity 18*a* of screw 18 and to engage a corresponding tapped hole formed in wedge 7. The head of this screw 22 is so dimensioned that the screw can be inserted with a sufficient clearance into the axial recess 18*a* of hollow screw 18. This screw 18 may be rotatably driven by means of an internally screw-threaded sprocket 23 mounted coaxially to the screw 18 in a recess 24 of bolster 8 and formed with a tapped bore engageable by a corresponding threaded portion 25 of screw 18.

The sprocket 23 may in turn be rotated by a driving a system comprising a roller chain 26 engaging the teeth 27 of sprocket 23 so that when this sprocket is rotatably driven it causes the axial translation of screw 18 in socket 21 and consequently the sliding movement of wedge 7 on the inclined ramp 9*a*. Therefore, according to whether the roller chain 26 drives the sprocket 23 in one or the other direction, the inclined face of skew wedge 7 will slide on the other wedge 9 in one or the other direction and produce at this location a corresponding bending or bulging of the bolster 8 and of the folding tool carried thereby.

Figure 5:
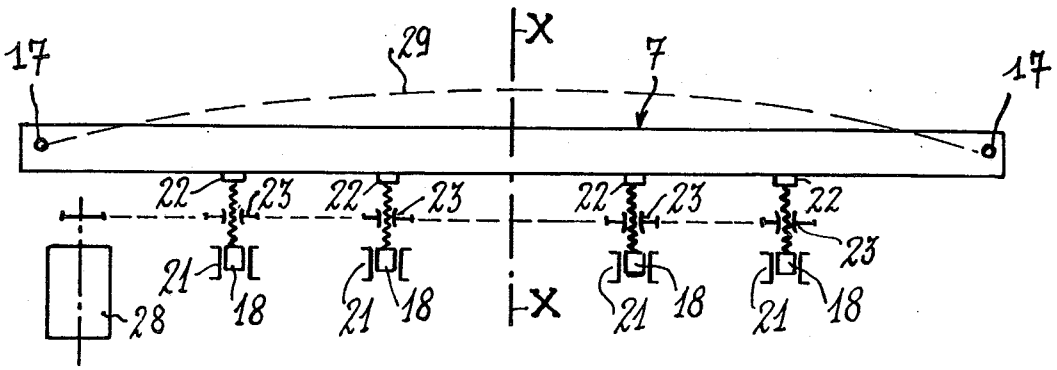
FIG. 5 is a simplified diagrammatic plan view from above showing a first form of embodiment of the tapered wedge of this invention and of its distortion control system.

The devices comprising the screw 18 and sprocket 23 for controlling the wedge 7 are thus disposed at spaced intervals along this wedge and symmetrically on either side of its transverse axis X-X, as clearly shown in FIG. 5. Thus, all the sprockets 23 are coupled through the single drive chain 26 which may be actuated either manually, for example by means of an end handwheel (not shown), or by power means such as a motor 28 shown diagrammatically in FIG. 5.

When the sprockets 23 are rotated, all the screws 22 (the number of which is of course subordinate to the length of wedge 7) accomplish an axial movement, thus exerting a thrust against as many corresponding points of this skew wedge 7.

To bend this skew wedge 7 according to the concave curve 29 of FIG. 5, the screws 18 are provided with different screw thread pitches having values increasing in the direction towards the machine axis X-X.

The motor 28 may be controlled either through switch means or through programme means in case the machine were controlled by a digital computer. A programme control system is particularly advantageous because it permits of adjusting the sagitta automatically after displaying the characteristics of the sheet metal workpiece to be folded and the tools therefor.

The horizontal deformation of the skew wedge 7 takes place in such a way that the wedge will gradually slide on its inclined face 7*a* on the matching inclined face 9*a* of wedge 9 between the fixed end points 17 and the center of the machine. Thus, the wedge 7 will undergo likewise a distortion in the vertical plane.

The bolster 8 constantly bearing against wedge 7 due to the presence of screws 13 and spring washers 14 undergoes a deformation in the same way, and this also applies to the bending die supported by bolster 8.

These deformations, of relatively low value with respect to the longitudinal dimensions of the workpieces, are perfectly elastic so that the rectilinear shape of bolster 8 can be resumed at any time.

The initial setting of the skew wedge 7 permits of making up for a possible deficient linearity of one or the other beams 1, 2 and obtaining a constant relative spacing of these beams throughout their length.

The setting of screws 18 against the skew wedge 7 in its initial position is obtained by removing the splined socket 21 and rotating the screw 18 to the desired position. When this position is attained, the socket 21 is refitted in position and locked against rotation.

Simplicity is one of the major features characterizing the above-described bending device due to the use of a single, relatively long wedge 7 that can be easily deformed by using a single system for controlling all the thrust points. Since only relatively moderate efforts are required for controlling the wedge deformation, a relatively small motor 28, for example a step-by-step programme-controlled motor, may be used for this purpose.

In the second form of embodiment illustrated in FIGS. 6 and 7 the top movable and deformable wedge 37 and its fixed support member 39 consist of two identical members extending from one end to the other end of the tool holding bolster (8). The longitudinal bottom face 37*a* of top wedge 37 has a variable slope cooperating with a matching longitudinal face 39*a* of the fixed bottom wedge 39 which is formed on the top surface of this wedge 39.

Holes similar to those formed in wedges 7 and 9 are formed in wedges 37 and 39 for engagement by the screws 13.

The two variable-slope surfaces 37*a* and 39*a* are complementary to each other so that when the wedges 37 and 39 are laid upon each other with the faces 37*a* and 39*a* in mutual contact, the wedge assembly thus obtained constitutes a regular parallelipiped, the vertical faces 40 and 41 of wedges 37 and 39 respectively lying in a common vertical plane. Each surface 37*a*, 39*a* is defined by the grid surface 39*a* of FIG. 6.

Straight lines 43 through 49 are traced across the surface 39*a* extending from one end of wedge 39 to its middle point 0 through which the last straight line 49 is traced. More particularly, said lines 43 to 49 are the intersections of vertical parallel planes with said surface 39*a*, and it will be seen that the inclination of said lines 43 to 49 to the horizontal increases gradually, from the end of wedge 39 to the center thereof, from zero to an angle $\alpha$ at the wedge center. Of course, the same but symmetrical configuration is applied to the area extending from line 49 to the opposite end of wedge 39.

In its initial position, the movable and deformable wedge 37 bears on wedge 39 in such a manner that the variable-slope surfaces 37*a* and 39*a* are pressed against each other at each one of their surface points.

When transverse thrusts are applied to different points of wedge 37 by means of the devices illustrated in FIG. 4, the wedge 37 is moved in a direction across wedge 39, and due to the movement of surface 37*a* on its companion surface 39*a* (and also to the action of screws 13 and spring washers 14) the top wedge 37 is bent to provide the desired top camber 37*b* (FIG. 7).

This result is obtained because when the two surfaces 37*a*, 39*a* are superposed all the points thereof can be caused to contact each other in only one position, that is, the position in which the vertical faces 40 and 41 lie in a common vertical plane (this also applying to the transverse vertical faces of the wedges). When one of the surfaces 37*a*, 39*a* is shifted in relation to the other, these surfaces cannot coincide with each other unless one of them is deformed, thus causing the top surface of wedge 37 to bulge.

The specific advantage characterizing this second form of embodiment lies in the fact that to bend the wedge 37 it is only necessary to impart a transverse movement of translation to this wedge. Thus, the fixed points at the ends of wedge 37 are eliminated and the transverse thrusts can be exerted by means of identical control members (screws 18 and sprockets 23).

However, this invention should not be construed as being strictly limited by the specific forms of embodiment described and illustrated herein, since modifications and changes may be brought thereto without departing from the basic principles of the invention. Thus, the screws 18 may comprise polygonal heads instead of splines 19 which cooperate with matching polygonal hollow portions of sockets 21. A deformable wedge such as 7 may be mounted in the movable top bolster instead of in the fixed bottom bolster. The support 9 may form an integral part of beam 1 and be machined therewith.

What is claimed as new is:

1. Device for bending the tool holder of a folding press comprising a fixed beam (1) and a movable beam (2) adapted to keep a constant distance between the cooperating tools fastened to said beams (1, 2) during the folding of a sheet metal between said beams, the device comprising a single wedge (7) extending throughout the length of one of the tool holders (8) associated with said beams (1, 2), said wedge having one major face (7*a*) inclined transversely to the folding direction and in sliding bearing engagement with a supporting member (9), and means for exerting transverse thrusts at different points disposed at spaced intervals along said wedge (7) in order to cause an elastic deformation of said wedge (7) by causing its inclined face (7*a*) to slide and thus bend the tool holder (8) and the tool carried thereby, wherein the means for controlling the deformation of said wedge (7) comprise at each transverse thrust point a hollow screw (18) engaged in a socket (21) rigid with the tool holder (8) but adapted to move only axially in said socket (21), a member (22) for securing said screw (18) to the wedge (7), a sprocket (23) mounted coaxially to said screw (18) and formed with internal screw threads engaging the male threads of said screw (18), for controlling the axial position of said screw (18) in said socket (21), and a single system (26) for controlling the rotation of all the sprockets of the folding press and consequently the movement of the wedge through the thrusts exerted by said hollow screw (18) on said wedge (7), said exerting means moving different portions of said wedge different distances upon actuation of said single system thereby to deform the wedge.

2. The device of claim 1, wherein said system for controlling the sprocket (23) rotation comprises a roller chain (26) drivingly engaging all the sprockets of the bending device, and means to circulate said chain.

3. The device of claim 1, wherein said supporting member (9) consists of a second fixed wedge extending throughout the length of the tool holder (8) and interposed between the first movable wedge (7) and the body of the corresponding beam (1), holes (12) being formed through said wedges (7, 9) for engagement by the members provided for fastening the tool holder to the beam body, such as screws (13), the holes (12) formed through the movable wedge (7) having an elongated cross-sectional configuration to provide a transverse clearance on either side of the fastening members (13) and permit a transverse free movement of said wedge (7) with respect to its supporting member (9).

4. The device of claim 1, wherein said member supporting the movable wedge (7) is an integral part of the body of said beam (1).

5. The device of claim 1, wherein said means for exerting a thrust against said wedge (7) are adapted to impart an adjustable curvature (29) to said wedge and thus bend the tool holder (8) and the tool supported thereby through the medium of hollow screws (18) having screw threads of which the pitch increases from the wedge ends to the wedge center, said wedge (7) being secured at its ends.

6. The device of claim 1, wherein said hollow screw (18) has a splined or polygonal head engaged in a correspondingly shaped cavity of said socket (21).

7. Device for bending the tool holder of a folding press comprising a fixed beam and a movable beam adapted to keep a constant distance between the cooperating tools fastened to said beams during the folding of a sheet metal between said beams, the device comprising a single wedge extending throughout the length of one of the tool holders associated with said beams, said wedge having one major face inclined transversely to the folding direction and in sliding bearing engagement with a supporting wedge member, and means for exerting transverse thrusts at different points disposed at spaced intervals along said wedge in order to cause an elastic deformation of said wedge by causing its inclined face to slide and thus bend the tool holder and the tool carried thereby, wherein the means for controlling the deformation of said wedge comprise at each transverse thrust point a hollow screw engaged in a socket rigid with the tool holder but adapted to move only axially in said socket, a member for securing said screw to the wedge, a sprocket mounted coaxially to said screw and formed with internal screw threads engaging the male threads of said screw, for controlling the axial position of said screw in said socket, and a single system for controlling the rotation of all the sprockets of the folding press and consequently the movement of the wedge through the thrusts exerted by said hollow screw on said wedge, said movable wedge (37) and its supporting wedge member (39) consisting of two identical members extending from one end to the opposite end of the tool holder (8), each wedge (37, 39) having a longitudinal surface (37*a*, 39*a*) coupled to the corresponding longitudinal surface of the other wedge and a variable transverse slope such that when the top wedge (37) is turned upside down on the bottom wedge (39) with the vertical faces (40, 41) of both wedges disposed in a common vertical plane, said coupled surfaces (37*a*, 39*a*) engage each other at all points thereof, and the transverse translation of the top wedge (37) on the variable-inclination surface (39*a*) of the bottom wedge (39) and throughout its length causes the bending of the top wedge (37) and of the corresponding beam.

8. The device of claim 7, wherein the transverse slope of each variable-slope surface (37*a*, 39*a*) to the horizontal increases from the wedge ends to the center thereof from zero value to an angle ($\alpha$) greater than zero.

* * * * *